US010729221B2

(12) United States Patent
Kang

(10) Patent No.: US 10,729,221 B2
(45) Date of Patent: Aug. 4, 2020

(54) COSMETIC CONTAINER HAVING AIR ENTRANCE/EXIT UNIT

(71) Applicant: Seong Il Kang, Seongnam-si (KR)

(72) Inventor: Seong Il Kang, Seongnam-si (KR)

( * ) Notice: Subject to any disclaimer, the term of this patent is extended or adjusted under 35 U.S.C. 154(b) by 0 days.

(21) Appl. No.: 15/573,318

(22) PCT Filed: May 10, 2016

(86) PCT No.: PCT/KR2016/004865
§ 371 (c)(1),
(2) Date: Nov. 10, 2017

(87) PCT Pub. No.: WO2016/182309
PCT Pub. Date: Nov. 17, 2016

(65) Prior Publication Data

US 2018/0132595 A1 May 17, 2018

(30) Foreign Application Priority Data

May 12, 2015 (KR) ..... 10-2015-0065802

(51) Int. Cl.
*A45D 40/00* (2006.01)
*A45D 40/22* (2006.01)
(Continued)

(52) U.S. Cl.
CPC ..... *A45D 40/221* (2013.01); *A45D 33/24* (2013.01); *A45D 34/00* (2013.01); *A45D 40/222* (2013.01);
(Continued)

(58) Field of Classification Search
CPC ..... A45D 34/00; A45D 2200/051; A45D 2040/223; A45D 40/222; A45D 40/221;
(Continued)

(56) References Cited

U.S. PATENT DOCUMENTS 1,694,727 A * 12/1928 Allen ..... A45D 33/025 132/299
6,986,355 B2 * 1/2006 Byun ..... A45D 33/006 132/287
(Continued)

FOREIGN PATENT DOCUMENTS

JP 2013-248138 A 12/2013
JP 2013248138 A * 12/2013 ..... A45D 33/00
(Continued)

OTHER PUBLICATIONS

Translation of JP 2013248138. MURATA, Dec. 12, 2013, Paragraph 26. (Year: 2013).*

*Primary Examiner* — Gideon R Weinerth
(74) *Attorney, Agent, or Firm* — Novick, Kim & Lee, PLLC; Jae Youn Kim

(57) ABSTRACT

Provided is a cosmetic container having an air entrance/exit unit, in which an outer container lid is opened/closed in an outer container, and a cosmetic container in which a sealing lid is opened/closed is coupled to an inside of the outer container, wherein an air entrance/exit unit is installed in a rectangular hole formed at a portion of an outer wall of the cosmetic container, and the air entrance/exit unit includes a stopping protrusion protruding from an outer periphery of a hinge piece of the outer container lid, a rectangular rubber member inserted into the rectangular hole of the cosmetic container, and an air entrance/exit member inserted into a central hole of the rectangular rubber member.

3 Claims, 8 Drawing Sheets

(51) Int. Cl.
*A45D 33/00* (2006.01)
*A45D 33/24* (2006.01)
*A45D 34/00* (2006.01)

(52) U.S. Cl.
CPC ..... *A45D 40/22* (2013.01); *A45D 2040/223* (2013.01); *A45D 2200/051* (2013.01)

(58) Field of Classification Search
CPC ..... A45D 33/24; A45D 33/16; A45D 33/02; A45D 33/22; A45D 33/00; A45D 40/22; A45D 33/006; A45D 2040/051; B05B 11/3043
USPC ..... 220/23.86, 367.1, 259.1, 259.2; 206/37, 206/823, 581; 132/293, 300
See application file for complete search history.

(56) References Cited

U.S. PATENT DOCUMENTS

| | | | | |
|---|---|---|---|---|
| 7,597,211 | B2 * | 10/2009 | Kang | A45D 33/006 132/293 |
| 8,251,075 | B2 * | 8/2012 | Breese | A45D 34/04 132/299 |
| RE46,854 | E * | 5/2018 | Byeon | |
| 2007/0215494 | A1 * | 9/2007 | Yuhara | A45D 33/006 206/37 |
| 2012/0305606 | A1 * | 12/2012 | Lee | A45D 33/02 222/256 |
| 2016/0015149 | A1 * | 1/2016 | Kim | A45D 40/22 222/383.1 |
| 2016/0157585 | A1 * | 6/2016 | Kang | A45D 33/006 220/259.2 |
| 2016/0161359 | A1 * | 6/2016 | Kang | A45D 34/00 73/49.3 |
| 2017/0273437 | A1 * | 9/2017 | Kim | A45D 34/00 |
| 2017/0318938 | A1 * | 11/2017 | Lee | A45D 40/0075 |
| 2017/0347772 | A1 * | 12/2017 | Kang | A45D 34/00 |
| 2018/0132595 | A1 * | 5/2018 | Kang | A45D 33/24 |
| 2018/0238766 | A1 * | 8/2018 | Kang | A45D 34/00 |
| 2019/0183231 | A1 * | 6/2019 | Lee | B65D 43/16 |
| 2019/0200724 | A1 * | 7/2019 | Lee | A45D 33/008 |
| 2020/0023393 | A1 * | 1/2020 | Kang | A45D 40/24 |

FOREIGN PATENT DOCUMENTS

| | | | |
|---|---|---|---|
| KR | 20-0306854 | Y1 | 3/2003 |
| KR | 10-2007-0120007 | A | 12/2007 |
| KR | 10-0945325 | B1 | 3/2010 |
| KR | 10-2014-0062397 | A | 5/2014 |
| KR | 20-2015-0000596 | U | 2/2015 |
| KR | 10-1594275 | B1 | 2/2016 |

* cited by examiner

COSMETIC CONTAINER HAVING AIR ENTRANCE/EXIT UNIT

CROSS-REFERENCE(S) TO RELATED APPLICATION

This is a 371 application of PCT/KR2016/004865 filed May 10, 2016, which claims priority of Korean Patent Application No. KR 10-2015-0065802, filed on May 12, 2015, in the Korean Intellectual Property Office, which is hereby incorporated by reference in its entirety.

BACKGROUND OF THE INVENTION

Field of the Invention

The present disclosure relates to a cosmetic container having an air entrance/exit unit, and more particularly, to a cosmetic container having an air entrance/exit unit, in which as an outer container lid is opened/closed, air is automatically introduced into the cosmetic container.

Description of the Related Art

In general, cosmetics contain a large amount of moisture or volatile ingredients such as alcohol. Thus, when a cosmetic container is not completely sealed, because the moisture is evaporated and the volatile elements are volatilized, an amount of the cosmetics is reduced. Further, because a compounding ratio of cosmetic ingredients is changed due to the evaporation of the moisture or the volatilization of the volatile ingredients, performance of the cosmetics is degraded.

In addition, when the moisture is evaporated or the volatile ingredients are volatilized, because the cosmetics are dried, and lose an original function thereof, it is very important to store the cosmetics such that original ingredients of the cosmetics are always maintained.

Therefore, to prevent the loss of the function, a sealing lid for maintaining airtightness for preventing evaporation of moisture and volatilization of volatile ingredients and is installed in the conventional cosmetic container. In general, an elastic packing is installed in the conventional cosmetic container to maintain airtightness of the cosmetic container in which cosmetics are contained, so that the airtightness is secured.

In the conventional cosmetic container having such a sealing lid, as illustrated in FIG. 7, in a cosmetic container 200 generally containing cosmetic materials 221, an elastic packing 220 is installed in a space between an inner wall 201 and an outer wall 202 of the cosmetic container 200, a sealing protrusion 241 is formed in a sealing lid 240 opened and closed through rotation about a hinge 250, and the sealing protrusion 241 of the sealing lid 240 presses the packing 220 of the cosmetic container 200, so that the cosmetic container is sealed.

However, in the conventional cosmetic container 200, when the sealing lid 240 is always flat, and thus, the sealing protrusion 241 constantly presses all surfaces of the packing 220 of the cosmetic container 200, a sealing force may be maintained. Here, because the sealing lid 240 is generally made of synthetic resin, the flatness is changed by a shrinking phenomenon and a twisting phenomenon as a time elapses, and thus, the sealing force is reduced.

Accordingly, to resolve the problem of the conventional cosmetic container, the applicant proposes a cosmetic container 100 having an enhanced sealing force, which is disclosed in Utility Model No. 20-0306854, as illustrated in FIG. 8.

In the proposed cosmetic container 100 having an enhanced sealing force, an elastic packing 125 is installed in a space between an inner wall 123 and an outer wall 124 of the cosmetic container 100 containing cosmetic materials 121, a sealing protrusion 128 is formed in a sealing lid 126 opened and closed through rotation about a hinge 127, and the sealing protrusion 128 of the sealing lid 126 presses the packing 125 of the cosmetic container 100. Further, a pressing rod 116 is additionally formed in an outer lid 114 opened and closed through rotation about a hinge 115, and the pressing rod 116 of the outer lid 114 presses the closed sealing lid 126 once again, so that the sealing force is enhanced.

SUMMARY OF THE INVENTION

The present disclosure is conceived to resolve the problems of the related art, and an aspect of the present disclosure is to provide a cosmetic container having an air entrance/exit unit, in which as an outer container lid is opened/closed, air is automatically introduced into the cosmetic container.

According to a first embodiment of the present disclosure, provided is a cosmetic container having an air entrance/exit unit, in which an outer container lid is opened/closed in an outer container and a cosmetic container in which a sealing lid is opened/closed is coupled to an inside of the outer container, wherein an air entrance/exit unit is installed in a rectangular hole formed at a portion of an outer wall of the cosmetic container, and the air entrance/exit unit includes a stopping protrusion protruding from an outer periphery of a hinge piece of the outer container lid, a rectangular rubber member inserted into the rectangular hole of the cosmetic container, and an air entrance/exit member inserted into a central hole of the rectangular rubber member, and when the outer container lid is opened, lifted up by contact with the hinge piece to allow air to be introduced/discharged between the air entrance/exit member and an inner peripheral surface of the central hole of the rectangular rubber member.

Here, the stopping protrusion may protrude at an angle at which the stopping protrusion comes into contact with a distal end of the air entrance/exit member when the outer container lid is opened through rotation about the hinge piece.

Further, the rectangular rubber member may have an edge groove inserted into an inner peripheral surface of the rectangular hole of the cosmetic container to maintain airtightness, and the air entrance/exit member, which is a rectangular rod-shaped member fitted with the central hole of the rectangular rubber member from the outside, may have a bent part bent upward such that the bent part comes into contact with the stopping protrusion when the outer container lid is opened through rotation about the hinge piece.

According to a second embodiment of the present disclosure, provided is a cosmetic container having an air entrance/exit unit, in which an outer container lid is opened/closed in an outer container and a cosmetic container in which a sealing lid is opened/closed is coupled to an inside of the outer container, wherein an air entrance/exit unit is installed in a rectangular hole formed at a portion of an outer wall of the cosmetic container, and the air entrance/exit unit includes a stopping protrusion protruding from an outer periphery of a hinge piece of the outer container lid, a rectangular rubber member, which is a rectangular member inserted into the rectangular hole of the cosmetic container, having a slit formed at the center thereof in a transverse direction, and an air entrance/exit protrusion integrally extending from an upper portion of the rectangular rubber member, and when the outer container lid is opened, lifted up by contact with the hinge piece to allow air to be introduced/discharged through the slit of the rectangular rubber member.

Here, the stopping protrusion may protrude at an angle at which the stopping protrusion comes into contact with a distal end of the air entrance/exit protrusion the outer container lid is opened through rotation about the hinge piece.

Further, the rectangular rubber member may have an edge groove inserted into an inner peripheral surface of the rectangular hole of the cosmetic container, and the air entrance/exit protrusion, which is a rectangular rod-shaped member protruding outward from an upper portion of the slit of the rectangular rubber member, may come into contact with the stopping protrusion when the outer container lid is opened through rotation about the hinge piece.

BRIEF DESCRIPTION OF THE DRAWINGS

The above and other aspects, features and advantages of certain exemplary embodiments of the present invention will be more apparent from the following description taken in conjunction with the accompanying drawings, in which.

DETAILED DESCRIPTION OF EXEMPLARY EMBODIMENTS

Hereinafter, exemplary embodiments of the present disclosure will be described in detail with reference to the accompanying drawings. Further, in description of the present disclosure, when it is determined that detailed descriptions of well-known configurations or functions make the subject matter the present disclosure unclear, the detailed descriptions will be omitted.

First Embodiment

Figure 1:
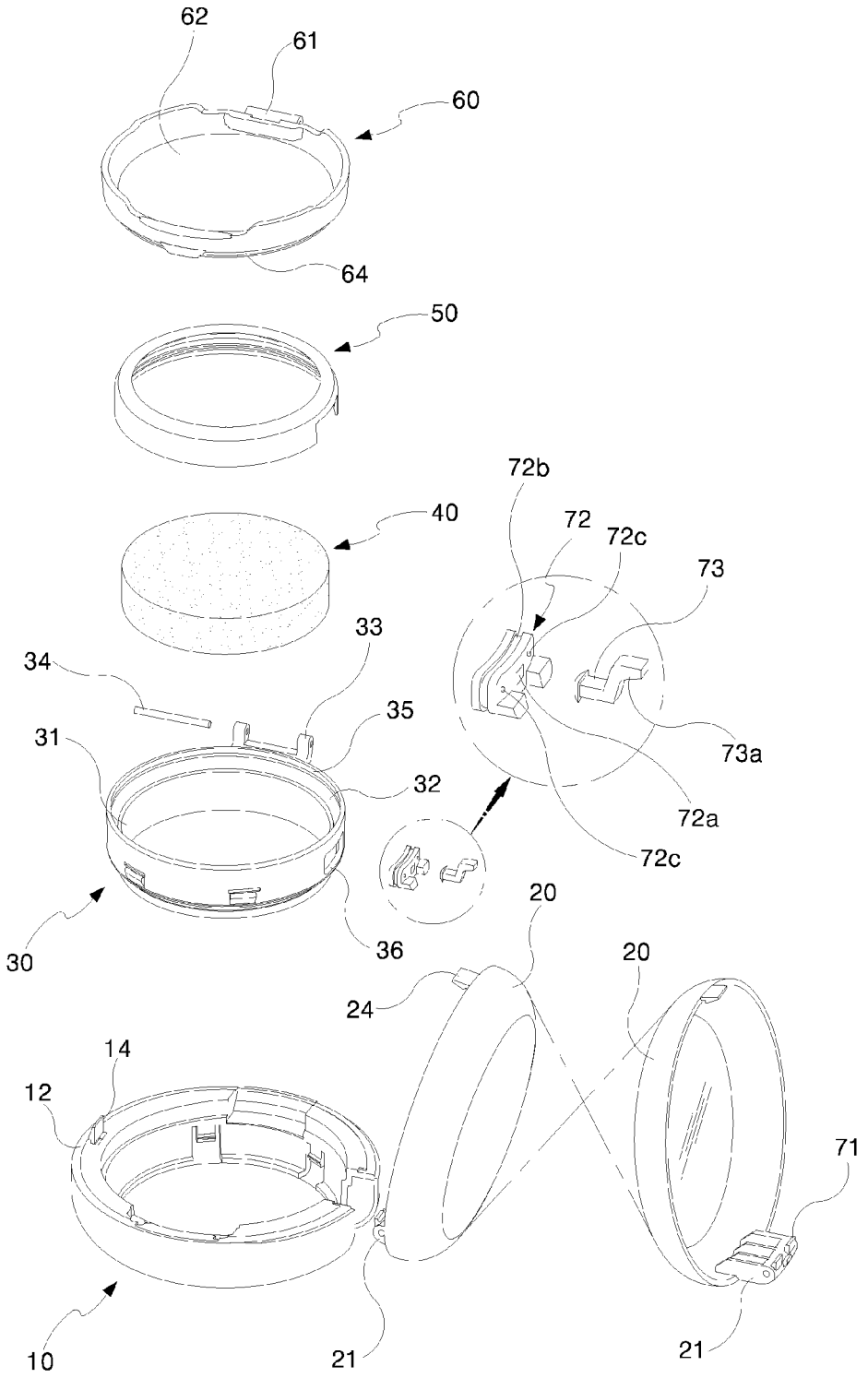
FIG. 1 is an exploded perspective view illustrating a cosmetic container having an air entrance/exit unit according to a first embodiment of the present disclosure.
Figure 2:
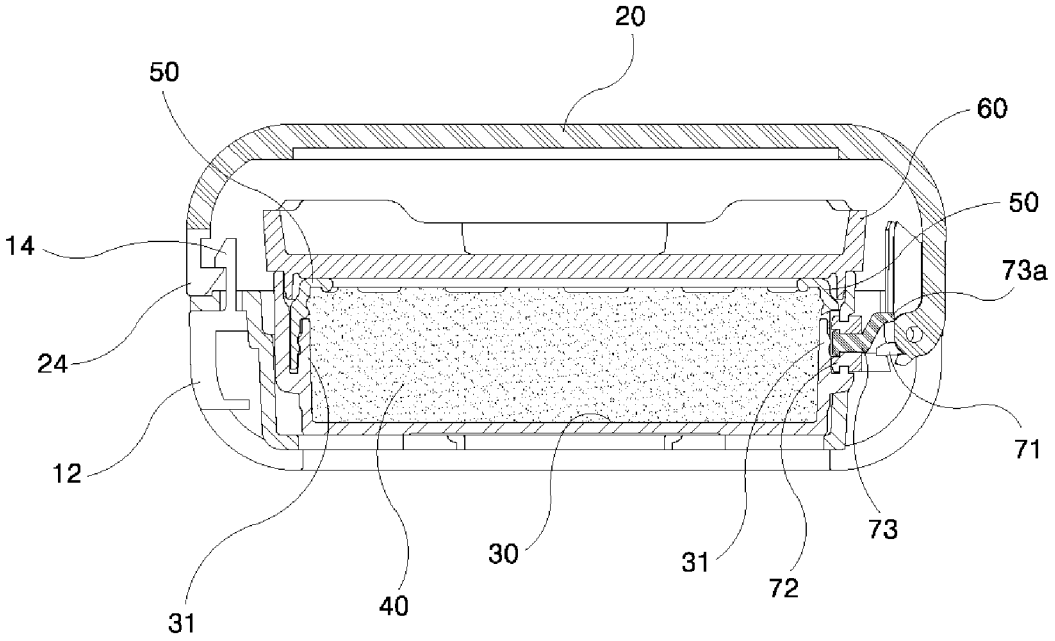
FIG. 2 is a sectional view illustrating the cosmetic container having an air entrance/exit unit according to the first embodiment of the present disclosure.
Figure 3:
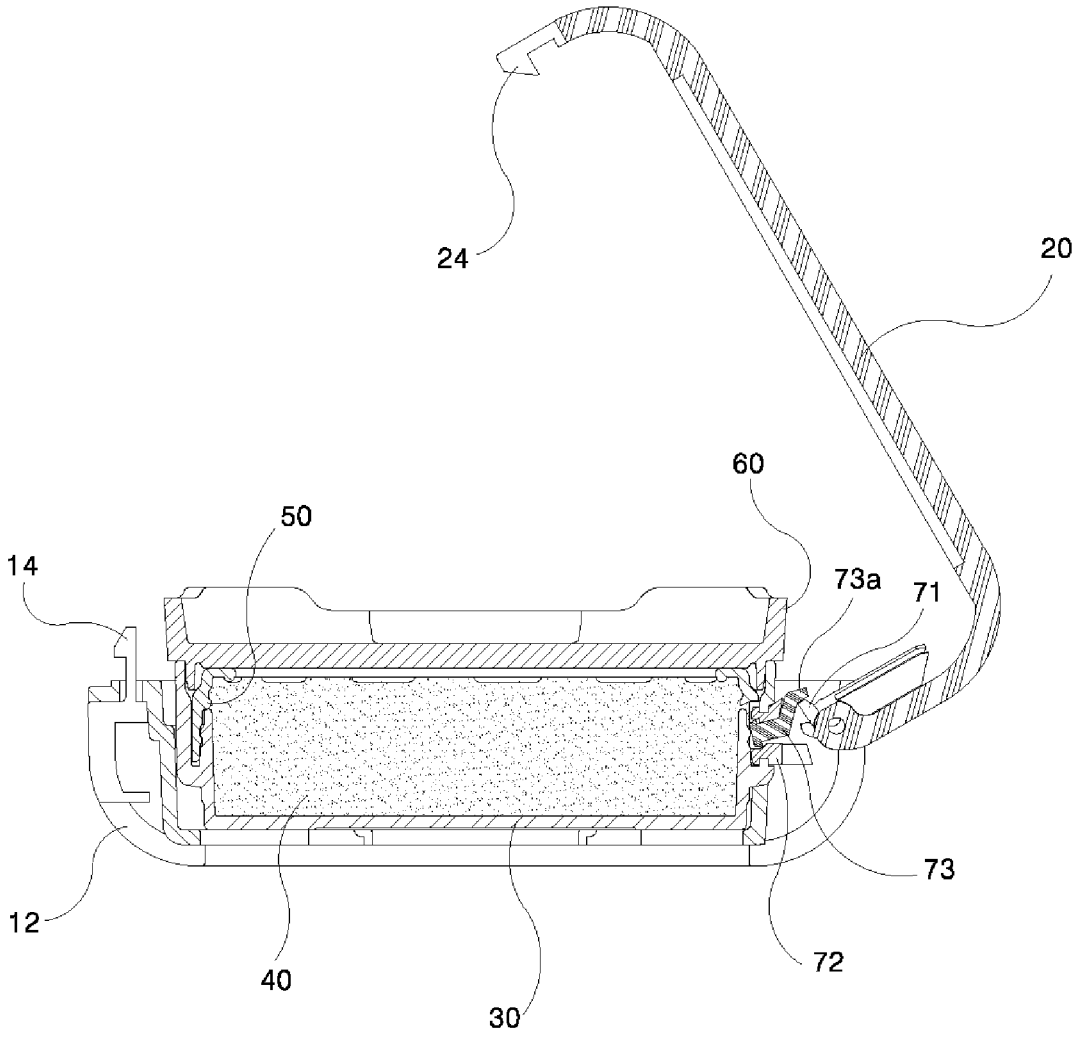
FIG. 3 is a sectional view when air is suctioned into the cosmetic container according to the first embodiment of the present disclosure.

FIG. 1 is an exploded perspective view illustrating a cosmetic container having an air entrance/exit unit according to a first embodiment of the present disclosure, FIG. 2 is a sectional view illustrating the cosmetic container having an air entrance/exit unit according to the first embodiment of the present disclosure, and FIG. 3 is a sectional view when air is suctioned into the cosmetic container according to the first embodiment of the present disclosure.

As illustrated in the drawings, according to the first embodiment of the present disclosure, an outer container lid 20 is opened/closed from/to an outer container 10 by a hinge piece 21, a cosmetic container 30 is coupled to an inside of the outer container 10, and a sealing lid 60 is opened/closed from/to the cosmetic container 30.

A button 12 from which a fastening protrusion 14 protrudes is installed on one surface of the outer container 10, and a hook 24 is formed in the outer container lid 20. Thus, when the outer container lid 20 is hinge-coupled to the outer container 10, the hook 24 of the outer container lid 20 is fastened to the fastening protrusion 14 of the button, so that the outer container lid 20 may be opened/closed.

Thereafter, when a user wants to open the outer container lid 20, if the button 12 is pressed, the fastening protrusion 14 is moved rearward and is unfastened form the hook 24, so that the outer container lid 20 may be opened from the outer container 10.

The cosmetic container 30 is inserted into and coupled to the outer container 10. At this time, cosmetics may be directly filled in the cosmetic container 30, or after cosmetic is impregnated in an impregnation member 40, the impregnation member 40 may be embedded in the cosmetic container 30.

When the impregnation member 40 is embedded in the cosmetic container 30, a fixing piece 50 is fitted between an inner wall 31 and an outer wall 32 of the cosmetic container 30 to prevent separation of the impregnation member 40.

An upper portion of the cosmetic container 30 is closed by closing the sealing lid 60. At this time, the sealing lid 60 is coupled to the cosmetic container 30 by a hinge.

When the sealing lid 60 is coupled to the cosmetic container 30 by the hinge, a first hinge block 33 is formed on an outer surface of one side of the cosmetic container 30, a second hinge block 61 is formed on an outer surface of one side of the sealing lid 60, and the sealing lid 60 is then coupled to the cosmetic container 30 by a hinge piece 34.

The sealing lid 60 includes a sealing plate 62 covering the cosmetic container 30, and a sealing protrusion wheel 64 protruding from an outer periphery of a lower surface of the sealing plate 62.

It is preferred that the sealing protrusion wheel 64 is made of polypropylene (PP) or polyethylene (PE) having strength and elasticity together to increase a sealing property. Further, it is preferred that the outer diameter of the sealing protrusion wheel 64 is larger than the inner diameter of an entrance of the cosmetic container 30, with which the sealing protrusion wheel 64 is fitted, by 0.1 to 0.3 mm to increase a sealing force.

The cosmetic container 30 has the inner wall 31 and the outer wall 32 on lateral surfaces thereof, and the fixing piece 50 is coupled between the inner wall 31 and the outer wall 32. In this case, it is preferred that a sealing extending protrusion wheel 35 integrally extends from an upper end of the outer wall 32 and is coupled to the sealing protrusion wheel 64 of the sealing lid 60. Further, it is preferred that the sealing extending protrusion wheel 35 is made of polypropylene (PP) or polyethylene (PE) having strength and elasticity together to increase a sealing property.

It is preferred that the inner diameter of the sealing extending protrusion wheel 35 is smaller than the outer diameter of the sealing protrusion wheel 64 of the sealing lid 60, which is fitted therewith, by 0.1 to 0.3 mm to increase a sealing force. Further, it is preferred that the thickness of the sealing extending protrusion wheel 35 is smaller than the thickness of the entrance of the outer wall 32 or the cosmetic container 30 such that the sealing extending protrusion wheel 35 is easily widened to the outside when the sealing protrusion wheel 64 is fitted with the sealing extending protrusion wheel 35.

A rectangular hole 36 is formed at a portion of the outer wall 32 of the cosmetic container 30. An air entrance/exit unit is installed in the rectangular hole 36.

The air entrance/exit unit includes a stopping protrusion 71 protruding from an outer periphery of the hinge piece 21 of the outer container lid 20, a rectangular rubber member 72 inserted into the rectangular hole 36 of the cosmetic container 30, and an air entrance/exit member 73 inserted into a central hole 72*a* of the rectangular rubber member 72, and when the outer container lid 20 is opened, lifted up by contact with the hinge piece 21 to allow air to be introduced/discharged between the air entrance/exit member 73 and an inner peripheral surface of the central hole 72*a* of the rectangular rubber member 72.

Airtightness checking grooves 72*c* are formed on opposite sides of the central hole 72*a*. The airtightness checking grooves 72*c* correspond to a display part for inspecting airtightness in the container by inserting a needle of an airtightness checker.

The stopping protrusion 71 protrudes at an angle at which it may come into contact with a distal end of the air entrance/exit member 73 when the outer container lid 20 is opened through rotation about the hinge piece 21.

The rectangular rubber member 72 has an edge groove 72*b* into which an inner peripheral surface of the rectangular hole 36 of the cosmetic container 30 is inserted so that airtightness is maintained.

The air entrance/exit member 73, which is a rectangular rod-shaped member fitted with the central hole 72*a* of the rectangular rubber member 72 from the outside, has a bent part 73*a* bent upward such that it may come into contact with the stopping protrusion 71 when the outer container lid 20 is opened through rotation about the hinge piece 21.

The rectangular rubber member 72 should be made of a material having excellent elasticity and high sealing force, and should not be denaturalized. Thus, It is preferred that the rectangular rubber member 72 is made of any one of synthetic resin or elastomer having excellent elasticity, silicone rubber, and NBR rubber.

Hereinafter, an assembling process and an effect of the above-configured cosmetic container having an air entrance/exit member according to the first embodiment of the present disclosure will be described below.

First, the rectangular rubber member 72 is fitted with the rectangular hole 36 perforated in the outer wall 32 of the cosmetic container 30, so that the inner peripheral surface of the rectangular hole 36 is fitted with and in close contact with the edge groove 72*b*. Further, the rod-shaped air entrance/exit member 73 is fitted with the central hole 72*a* of the rectangular rubber member 72, so that the bent part 73*a* protrudes outward.

In this state, the impregnation member 40 in which cosmetics are impregnated is inserted into the inner wall 31, and the fixing piece 50 is inserted between the inner wall 31 and the outer wall 32, so that an upper edge of the impregnation member 40 is fixed. In this state, because the inside of the cosmetic container 30 is evacuated, the sealing lid 60 cannot be closed.

That is, after the cosmetic container 30 in a state in which the sealing lid 60 is not closed is inserted into the outer container 10 from the upper side to the lower side, the sealing lid 60 is closed. Thus, because the outer container lid 20 is opened, that is, air is introduced into the cosmetic container 30 through the air entrance/exit unit, the inside of the cosmetic container 30 is not evacuated, so that the sealing lid 60 may be closed.

A usage state of the above-described cosmetic container having an air entrance/exit member according to the first embodiment of the present disclosure will be described below.

First, as illustrated in FIG. 2, when the sealing protrusion wheel 64 of the sealing lid 60 is tightly inserted into the sealing extending protrusion wheel 35 of the cosmetic container 30, and the outer container lid 20 is then closed, the cosmetic container 30 starts to be sealed.

In this way, when the cosmetic container 30 starts to be sealed, there is no concern that moisture in the cosmetic container 30 is evaporated or volatile ingredients in the cosmetic container 30 is volatilized.

Next, when the user wants to use cosmetics stored in the cosmetic container 30, first, the outer container lid 20 is opened while being rotated about the hinge piece 21 of the outer container lid 20 in a clockwise direction. While the outer container lid 20 is opened in this way, when the stopping protrusion 71 protruding from the hinge piece 21 at an angle comes into contact with a lower surface of the bent part 73*a* of the air entrance/exit member 73 to push and lift up the bent part 73*a*, a lower surface of the central hole 72*a* of the rectangular rubber member 72 is widened, and thus, air is introduced into the cosmetic container 30. While the air is introduced in this way, the vacuum state by a decompression phenomenon is resolved, so that the sealing lid 60 is opened (see FIG. 3).

Second Embodiment

Figure 4:
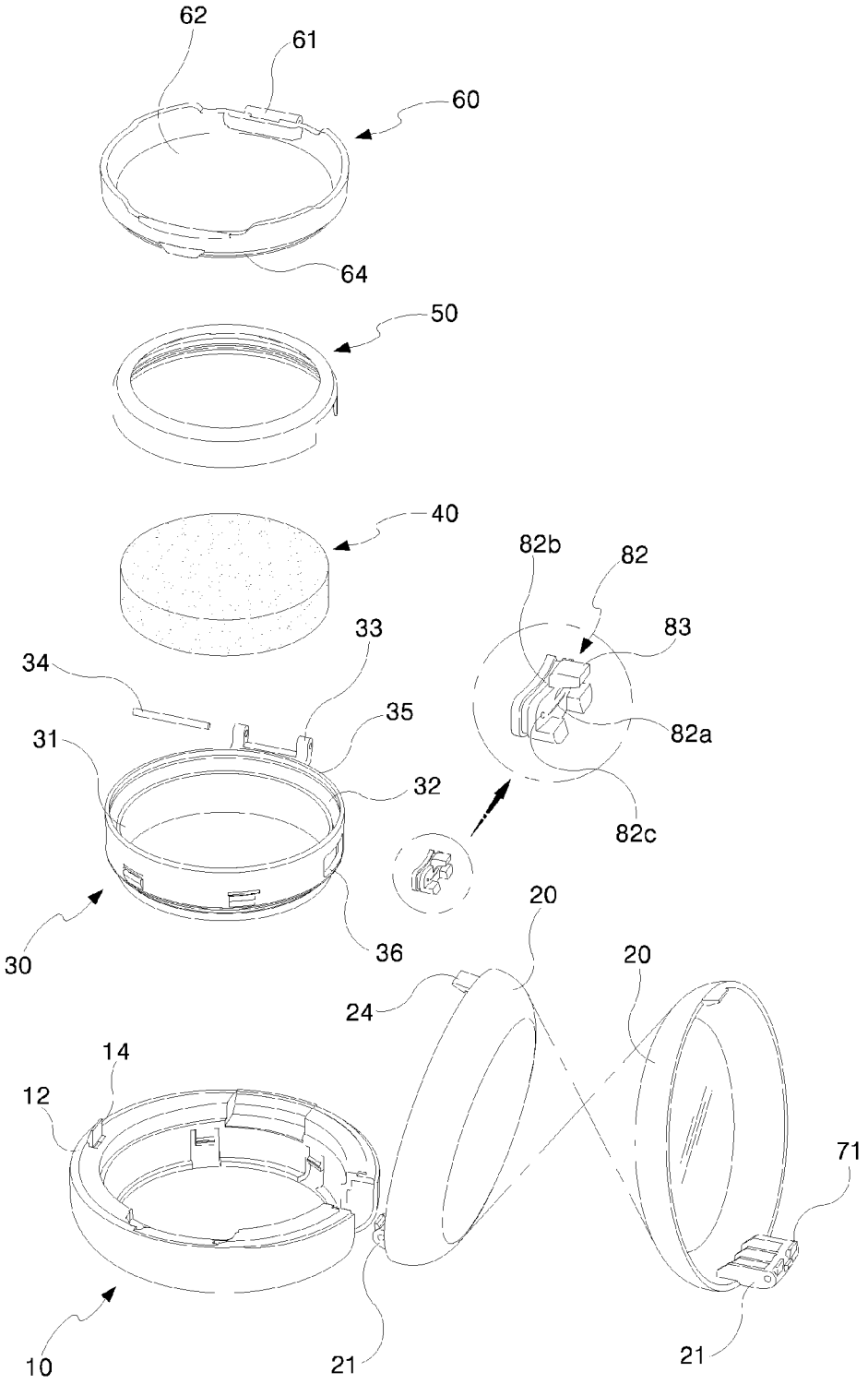
FIG. 4 is an exploded perspective view illustrating a cosmetic container having an air entrance/exit unit according to a second embodiment of the present disclosure.
Figure 5:
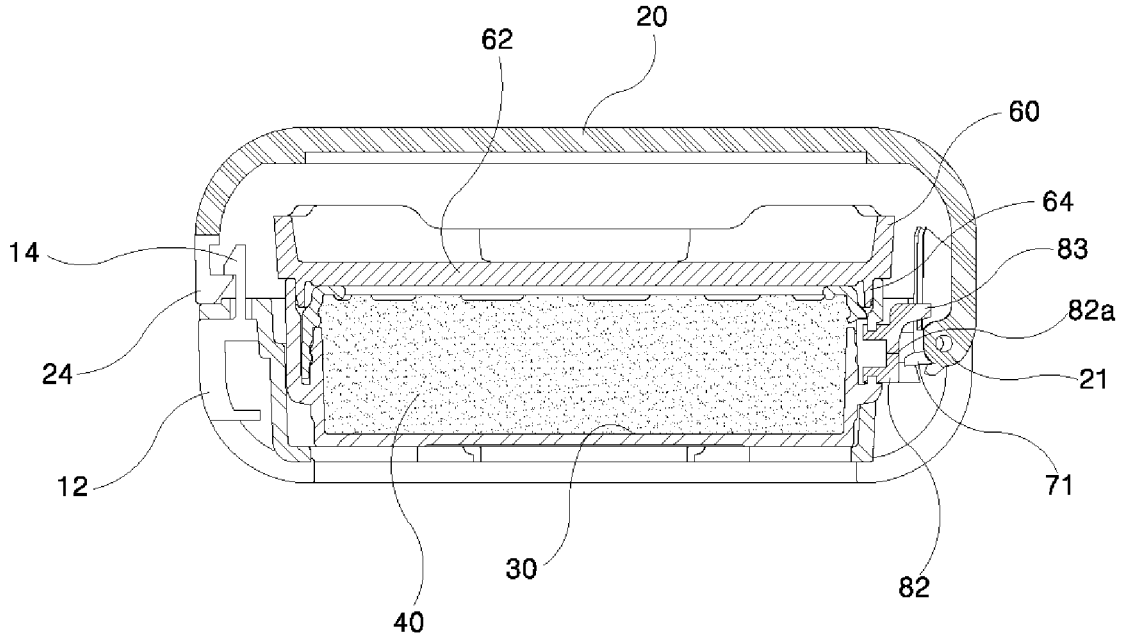
FIG. 5 is a sectional view illustrating the cosmetic container having an air entrance/exit unit according to the second embodiment of the present disclosure.
Figure 6:
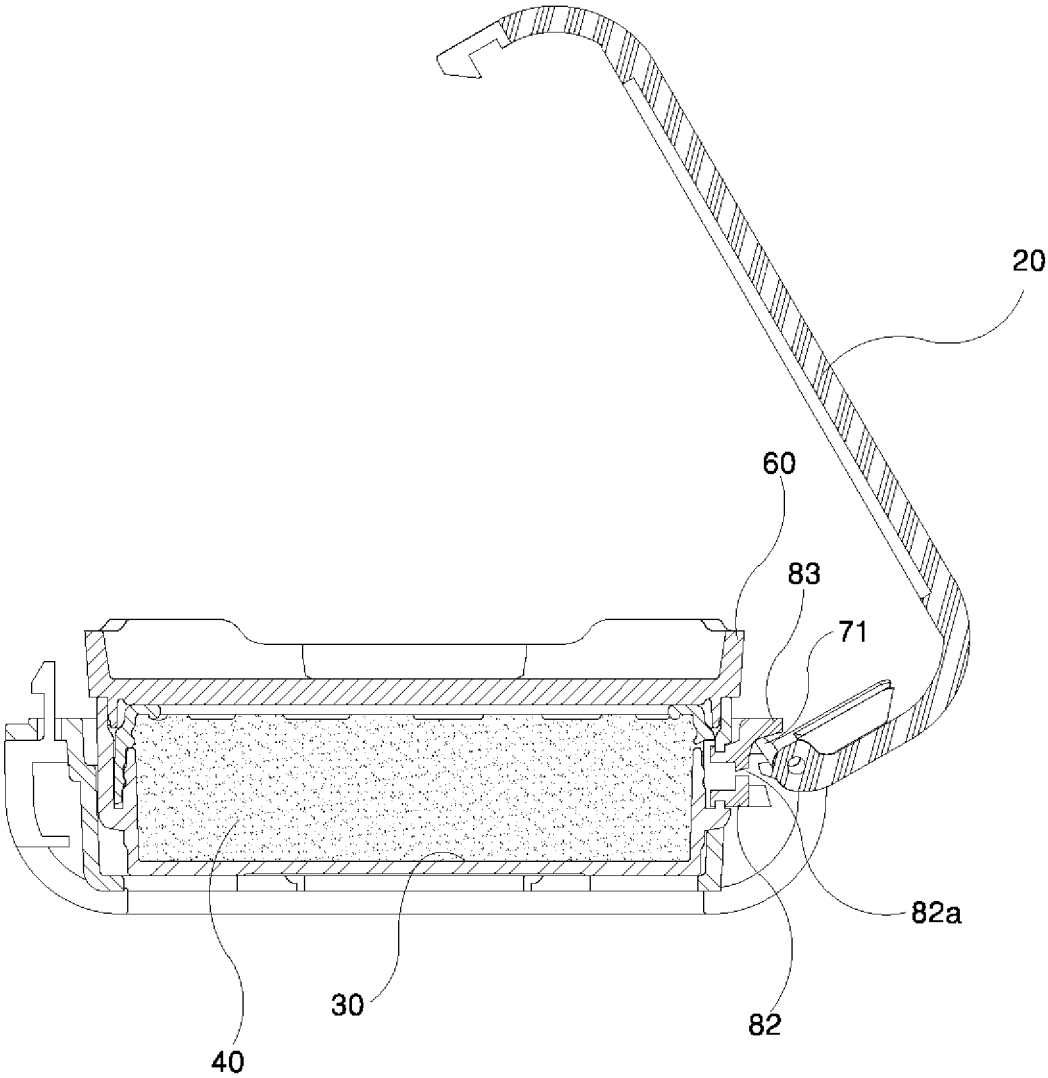
FIG. 6 is a sectional view when air is suctioned into the cosmetic container according to the second embodiment of the present disclosure.
Figure 7:
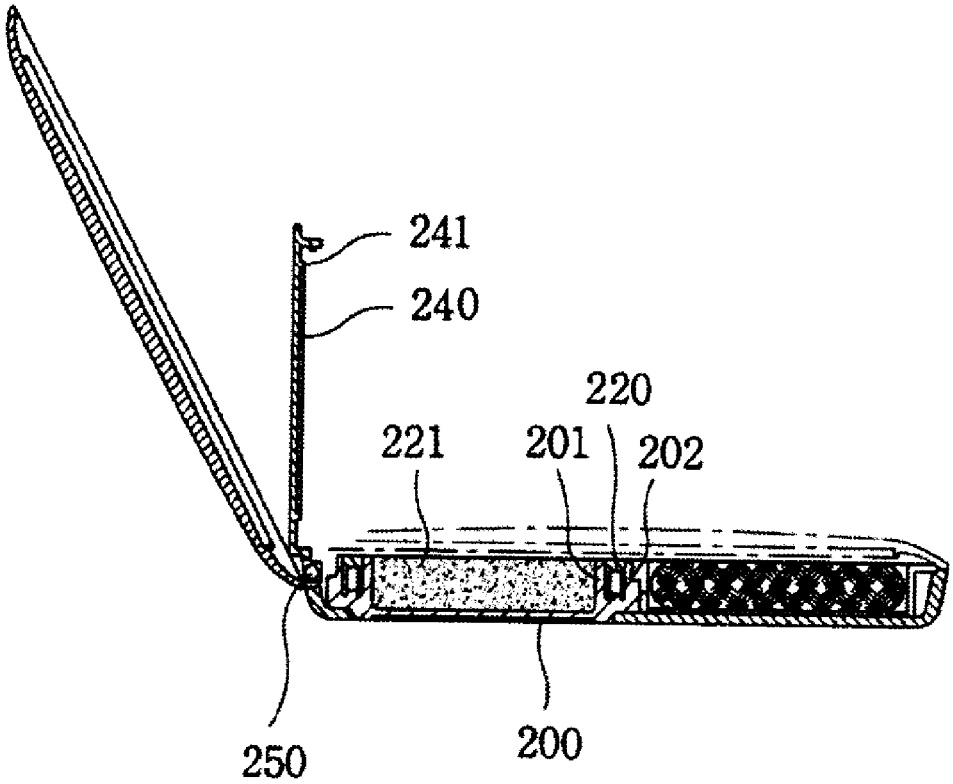
FIG. 7 PRIOR ART
FIG. 7 is a sectional view illustrating a cosmetic container having a sealing lid according to the related art.
Figure 8:
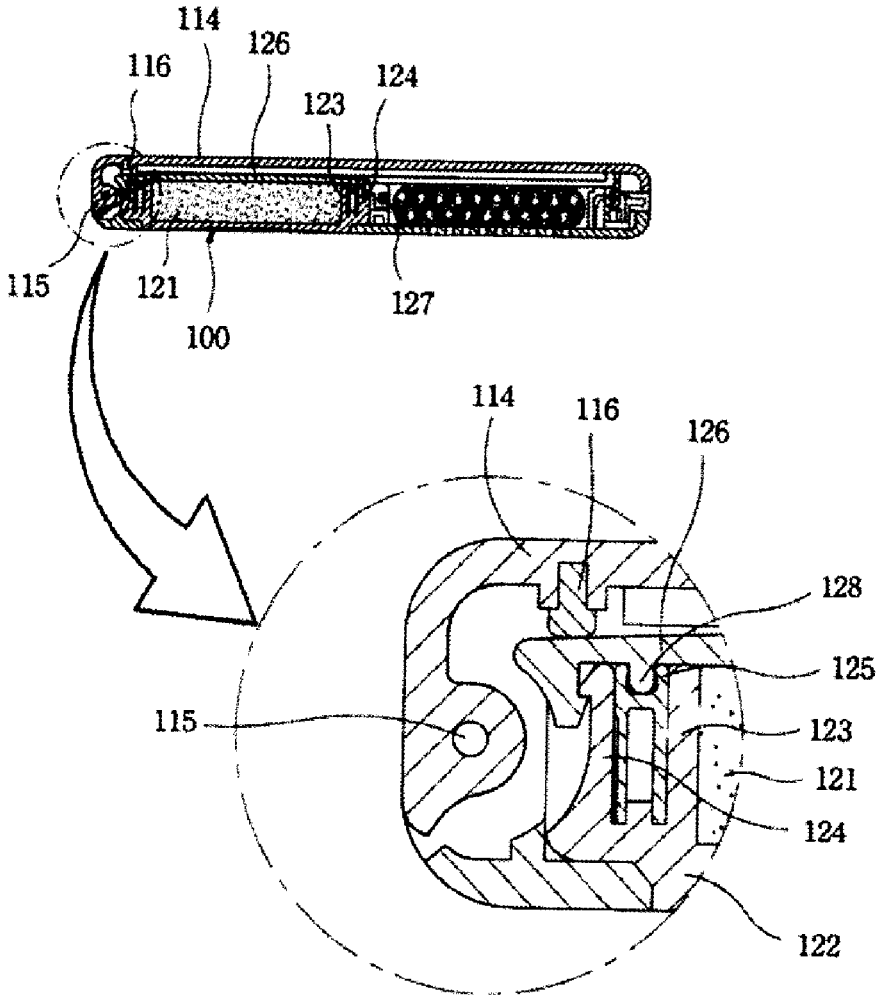
FIG. 8 PRIOR ART
FIG. 8 is a sectional view illustrating the cosmetic container having a sealing lid according to the related art in detail.

FIG. 4 is an exploded perspective view illustrating a cosmetic container having an air entrance/exit unit according to a second embodiment of the present disclosure, FIG. 5 is a sectional view illustrating the cosmetic container having an air entrance/exit unit according to the second embodiment of the present disclosure, and FIG. 6 is a sectional view when air is suctioned into the cosmetic container according to the second embodiment of the present disclosure.

The remaining parts of the second embodiment of the present disclosure, except for the air entrance/exit unit, are identical to those according to the first embodiment.

That is, as illustrated in FIGS. 4 to 6, the air entrance/exit unit includes a stopping protrusion 71 protruding from an outer periphery of the hinge piece 21 of the outer container lid 20, a rectangular rubber member 82, which is a rectangular member inserted into the rectangular hole 36 of the cosmetic container 30, having a slit 82*a* formed at the center thereof in a transverse direction, and an air entrance/exit protrusion 83 integrally extending from the upper side of the rectangular rubber member 82, and when the outer container lid 20 is opened, lifted up by contact with the hinge piece 21, to allow air to be introduced/discharged through the slit 82*a* of the rectangular rubber member 82.

The stopping protrusion 71 protrudes at an angle at which it may come into contact with a distal end of the air entrance/exit protrusion 83 when the outer container lid 20 is opened through rotation about the hinge piece 21.

The rectangular rubber member 82 has an edge groove 82*b* into which an inner peripheral surface of the rectangular hole 36 of the cosmetic container 30 is inserted so that airtightness is maintained.

The air entrance/exit protrusion 83, which is a rectangular rod-shaped member protruding outward from an upper portion of the slit 82*a* of the rectangular rubber member 82 from the outside, is formed such that it may come into contact with the stopping protrusion 71 when the outer container lid 20 is opened through rotation about the hinge piece 21.

Although the slit 82*a* may be one selected from a transverse straight-type slit and a cross-type slit, it is preferred that the slit 82*a* is the cross-type slit.

Airtightness checking grooves 82*c* are formed on opposite sides of the slit 82*a*. The airtightness checking grooves 82*c* correspond to a display part for inspecting airtightness in the container by inserting a needle of an airtightness checker.

The rectangular rubber member 82 should be made of a material having excellent elasticity and high sealing force, and should not be denaturalized. Thus, it is preferred that the rectangular rubber member 72 is made of any one of synthetic resin or elastomer having excellent elasticity, silicone rubber, and NBR rubber.

Hereinafter, an assembling process of the above-described cosmetic container having an air entrance/exit member according to the first embodiment of the present disclosure will be described below.

First, the rectangular rubber member 82 is fitted with the rectangular hole 36 perforated in the outer wall 32 of the cosmetic container 30, so that the inner peripheral surface of the rectangular hole 36 is fitted with and comes into close contact with the edge groove 82*b*.

In this state, the impregnation member 40 in which cosmetics are impregnated is inserted into the inner wall 31, and the fixing piece 50 is inserted between the inner wall 31 and the outer wall 32, so that an upper edge of the impregnation member 40 is fixed. In this state, because the inside of the cosmetic container 30 is evacuated, the sealing lid 60 cannot be closed.

That is, after the cosmetic container 30 in a state in which the sealing lid 60 is not closed is inserted into the outer container 10 from the upper side to the lower side, the sealing lid 60 is closed. Thus, because the outer container lid 20 is opened, that is, air is introduced into the cosmetic container 30 through the air entrance/exit unit, the inside of the cosmetic container 30 is not evacuated, so that the sealing lid 60 may be closed.

A usage state of the above-described cosmetic container having an air entrance/exit member according to the first embodiment of the present disclosure will be described below.

First, as illustrated in FIG. 5, when the sealing protrusion wheel 64 of the sealing lid 60 is tightly inserted into the sealing extending protrusion wheel 35 of the cosmetic container 30, and the outer container lid 20 is then closed, the cosmetic container 30 starts to be sealed.

In this way, when the cosmetic container 30 starts to be sealed, there is no concern that moisture in the cosmetic container 30 is evaporated or volatile ingredients in the cosmetic container 30 is volatilized.

Next, when the user wants to use cosmetics stored in the cosmetic container 30, the outer container lid 20 is opened while being rotated about the hinge piece 21 of the outer container lid 20 in a clockwise direction. While the outer container lid 20 is opened in this way, when the stopping protrusion 71 protruding from the hinge piece 21 at an angle comes into contact with a lower surface of the air entrance/exit protrusion 83 to push and lift up the air entrance/exit protrusion 83, the slit 82*a* of the rectangular rubber member 82 is widened, and thus, air is introduced into the cosmetic container 30. While the air is introduced in this way, the vacuum state by a decompression phenomenon is resolved, so that the sealing lid 60 is opened (see FIG. 6).

As described above, although the detailed embodiments have been described in the detailed description of the present disclosure, it is obvious that the technology of the present disclosure is easily modified by those skilled in the art, and the modified embodiments are included in the technical spirit claimed in the appended claims of the present disclosure.

What is claimed is:

1. A cosmetic container assembly comprising:

an outer container;

an outer container lid coupled to the outer container; a cosmetic container coupled to an inside of the outer container;

a sealing lid configured to open/close the cosmetic container;

an air entrance/exit unit installed in a rectangular hole disposed at a portion of an outer wall of the cosmetic container, wherein the air entrance/exit unit comprises:

a stopping protrusion protruding from an outer periphery of a hinge piece of the outer container lid;

a rectangular rubber member inserted into the rectangular hole of the cosmetic container, having a slit formed at a center thereof in a transverse direction; and an air entrance/exit protrusion integrally extending outwardly toward the outer container lid from an upper portion of the rectangular rubber member, and when the outer container lid is opened, lifted up by contact with the hinge piece to allow air to be introduced/discharged through the slit of the rectangular rubber member, wherein the stopping protrusion protrudes at an angle at which the stopping protrusion comes into contact with a distal end of the air entrance/exit protrusion when the outer container lid is opened through rotation about the hinge piece, wherein the rectangular rubber member has an edge groove inserted into an inner peripheral surface of the rectangular hole of the cosmetic container, and wherein the air entrance/exit protrusion, which is a rectangular rod-shaped member protruding outward from an upper portion of the slit of the rectangular rubber member, comes into contact with the stopping protrusion when the outer container lid is opened through rotation about the hinge piece, and wherein the air entrance/exit unit is configured such that, when the stopping protrusion protruding from the hinge piece comes into contact with a lower surface of the air entrance/exit protrusion to push and lift up the air entrance/exit protrusion, the slit of the rectangular rubber member is widened, and thus, air is introduced into the cosmetic container, and, the introduction of air decompresses a vacuum state within the cosmetic container, thereby allowing the sealing lid to be opened.

2. The cosmetic container assembly of claim 1, wherein the slit is one selected from a transverse straight-type slit and a cross-type slit.

3. The cosmetic container assembly of claim 1, wherein airtightness checking grooves configured to inspect airtightness in the cosmetic container by inserting a needle of an airtightness checker are formed on opposite sides of the slit.

* * * * *